US010224141B2

(12) United States Patent
Inoue et al.

(10) Patent No.: US 10,224,141 B2
(45) **Date of Patent: *Mar. 5, 2019**

(54) COUPLED INDUCTOR

(71) Applicant: Tamura Corporation, Tokyo (JP)

(72) Inventors: Naoki Inoue, Sakado (JP); Toshikazu Ninomiya, Sakado (JP)

(73) Assignee: TAMURA CORPORATION (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/705,666

(22) Filed: Sep. 15, 2017

(65) Prior Publication Data

US 2018/0005749 A1 Jan. 4, 2018

Related U.S. Application Data

(62) Division of application No. 14/213,178, filed on Mar. 14, 2014, now Pat. No. 9,799,440.

(30) Foreign Application Priority Data

Mar. 29, 2013 (JP) ..... 2013-074836

(51) Int. Cl.

| | |
|---|---|
| ***H01F 17/06*** | (2006.01) |
| ***H01F 27/24*** | (2006.01) |
| ***H01F 27/28*** | (2006.01) |
| ***H01F 3/10*** | (2006.01) |
| *H01F 27/26* | (2006.01) |

(52) U.S. Cl.

CPC ..... *H01F 27/24* (2013.01); *H01F 3/10* (2013.01); *H01F 27/28* (2013.01); *H01F 27/2847* (2013.01); *H01F 27/263* (2013.01)

(58) Field of Classification Search

USPC ..... 336/178, 212, 221, 96

See application file for complete search history.

(56) References Cited

U.S. PATENT DOCUMENTS

| | | | | |
|---|---|---|---|---|
| 4,447,795 | A * | 5/1984 | Sefko | H01F 27/245 336/178 |
| 5,315,279 | A | 5/1994 | Ito et al. | |
| 5,422,619 | A | 6/1995 | Yamaguchi et al. | |
| 6,617,950 | B2 * | 9/2003 | Gilmore | H01F 17/062 336/175 |
| 6,876,161 | B2 | 4/2005 | Chung | |
| 2002/0014280 | A1 | 2/2002 | Moro | |
| 2005/0099260 | A1 * | 5/2005 | Ahn | H01L 23/5227 336/223 |

(Continued)

FOREIGN PATENT DOCUMENTS

| | | |
|---|---|---|
| JP | H03150810 | 6/1991 |
| JP | 11-260618 | 9/1999 |

(Continued)

OTHER PUBLICATIONS

Japanese Application No. 2013-074836 Office Action dated Jun. 30, 2015, 8 pages w/English translation.

(Continued)

*Primary Examiner* — Elvin G Enad
*Assistant Examiner* — Kazi Hossain

(57) ABSTRACT

A coupled inductor comprises an annular core 1 and coils 2*a*, 2*b* wound around the core. The annular core 1 includes a sendust core having a maximum differential permeability that is equal to or greater than 30.

6 Claims, 5 Drawing Sheets

(56) References Cited

U.S. PATENT DOCUMENTS

| | | | | |
|---|---|---|---|---|
| 2005/0248426 | A1 | 11/2005 | Lin | |
| 2006/0103496 | A1 | 5/2006 | Lee | |
| 2007/0159289 | A1* | 7/2007 | Lee | H01F 27/24 336/212 |
| 2007/0236321 | A1 | 10/2007 | Iwai | |
| 2009/0121677 | A1 | 5/2009 | Inoue et al. | |
| 2010/0328007 | A1 | 12/2010 | Witzani et al. | |
| 2012/0098631 | A1* | 4/2012 | Ono | H01F 3/14 336/96 |
| 2012/0146759 | A1 | 6/2012 | Shibuya et al. | |
| 2012/0326829 | A1* | 12/2012 | Matsuda | H01F 27/2823 336/212 |
| 2013/0200975 | A1* | 8/2013 | Shudarek | H01F 3/14 336/170 |
| 2014/0218152 | A1* | 8/2014 | Ueno | H01F 37/00 336/165 |

FOREIGN PATENT DOCUMENTS

| | | |
|---|---|---|
| JP | 2000-014136 | 1/2000 |
| JP | 2002-291240 | 10/2002 |
| JP | 2004-327569 | 11/2004 |
| JP | 2007-324197 | 12/2007 |
| JP | 2010-062409 | 3/2010 |
| JP | 2012-065453 | 3/2012 |

OTHER PUBLICATIONS

Japanese Patent Application No. 2013-074836 Office Action dated Feb. 23, 2015, 6 pages with English translation.

Handa, S. et al. "Effects of Particle Shapes on DC-Biased Properties of Powder Cores and Modeling", vol. 35, No. 6, pps. 436-442, Journal of the Magnetics Society of Japan, Nov. 10, 2011 with English Abstract.

* cited by examiner

COUPLED INDUCTOR

CROSS-REFERENCE TO RELATED APPLICATIONS

This application is a divisional of U.S. patent application Ser. No. 14/213,178, filed on Mar. 14, 2014 and is based upon and claims the benefit of priority from Japanese Patent Application NO. 2013-074836, filed on Mar. 29, 2013; the entire contents of which are incorporated herein by reference.

FIELD OF THE INVENTION

The present disclosure relates to a coupled inductor having an improved magnetic material forming a core.

BACKGROUND ART

Coupled inductors utilized for DC/DC converters, etc., have two coils wound around one core, and allow currents to flow through the two coils, respectively, so as to generate magnetic fluxes generated from the respective coils in opposite directions as disclosed in JP 2000-14136 A, JP 2002-291240 A, and JP 2010-62409 A.

According to such coupled inductors of this kind, multiple reactors can be integrated while suppressing an increase of the flux density. Hence, such coupled inductors can be downsized. Accordingly, such coupled inductors are widely applied as a switching power source for electronic devices like a personal computer.

In recent years, coupled inductors are sometimes employed in an application in which a large current is necessary, i.e., it is attempted that such inductors are applied as an inductor for vehicular devices that allow a current of several 10 to 100 A to flow therethrough. According to a large-current application, it is necessary that a saturated flux density of the core is high. When, however, the saturated flux density is low, the flux density is easily saturated within the applied range, and thus an inductance value decreases. The decrease of the inductance value results in an increase of a ripple current, increasing the reactor loss.

JP 2010-62409 A discloses the use of a ferrite core as the core of the coupled inductor. However, such a core is not suitable for a large-current application because of the following reasons.

One of the features of a ferrite core is that a saturated flux density is low in comparison with other metal magnetic materials. For example, pure iron: 2 T, sendust: 1.1 T, and Mn—Zn ferrite: 0.3 to 0.4 T. In addition, a ferrite core has a higher magnetic permeability than dust cores. That is, dust core: μ50 to 200, and Mn—Zn ferrite core: equal to or greater than μ1000. In order to cause a ferrite core with a low saturated flux density to cope with a large-current application, it is necessary to increase the cross-sectional area of the core, and to provide a large gap in order to decrease the effective magnetic permeability of the reactor.

When, however, the gap becomes large, leakage fluxes from the gap may interlink with a winding, an aluminum casing, etc., to generate an eddy current. This causes a loss. In addition, this may increase a possibility that an efficiency is decreased and heat is generated. The necessary of a large gap decreases an initial inductance value (at the time of OA), and thus a ripple current increases.

In the case of a dust core, the saturated flux density of, the material itself is high, and the core itself has a low magnetic permeability. Accordingly, it is unnecessary to provide a large gap. Hence, the problem originating from the leakage flux and the reduction of the initial inductance value is avoidable. Accordingly, dust cores are excellent materials in comparison with ferrite cores, but a pure-iron-based dust core has a large core loss, and generates heat. Hence, dust cores are not suitable for a large-current application.

In a reactor characteristic, the maximum differential permeability represents an inductance (initial inductance value) when no load is applied (at the time of OA), but when this maximum differential permeability is too low, the initial inductance value becomes low, and thus a ripple current becomes large in a current waveform. When the ripple current becomes large, an effective current becomes also large, and thus the reactor loss becomes large, which may negatively affect other circuit components. According to conventional ferrite cores and dust cores, however, the maximum differential permeability is not usually taken into consideration, and it is difficult to overcome the aforementioned problems.

Several solutions to increase the initial inductance are possible, such as to increase the number of turns of winding, and to increase the cross-sectional area of the core, in addition to the maximum differential permeability, but those result in an increase in the size of the reactor. According to those countermeasures, a DC resistance increases, and thus a loss also increases. Accordingly, it is disadvantageous for reactors.

According to conventional coupled inductors, generation of heat is not a problem since a small current is caused to flow. Hence, coils formed of round magnet wires are popular. However, round magnet wires have a low winding space factor, and thus an inductor becomes large in size when applied to a large-current application. In addition, a coil is formed by turning the magnet wire in multiple layers, and thus the heat dissipation is not excellent.

It is an objective of the present disclosure to provide a coupled inductor that can satisfy both characteristics: saturated flux density; and reactor loss in a large-current application. It is another objective of the present disclosure to provide a coupled inductor that ensures an initial inductance value when no load is applied to be a predetermined value to reduce a ripple current, and that can decrease a loss.

SUMMARY OF THE INVENTION

An aspect of the present disclosure provides a coupled inductor that comprises: an annular core including a sendust core having a maximum differential permeability that is equal to or greater than 30; and a coil wound around the core. The annular core may be provided with one or more gaps of substantially 1 mm. It is preferable that the coil is formed of an edgewise winding that has a high winding space factor.

According to the present disclosure, the use of a sendust core suppresses both saturated flux density and core loss within appropriate ranges, enabling the use of a coupled inductor for a large-current application. Since the maximum differential permeability μ is set to be equal to or greater than 30 by the core alone, the initial inductance value of the reactor is increased even if no gap is formed, thereby suppressing a ripple current. As a result, it becomes unnecessary to increase the core cross-sectional area and to increase the number of turns of winding to suppress a ripple current, and an increase in the loss due to leakage fluxes can be suppressed since no gap is formed or a gap can be made small. Hence, the coupled inductor can be downsized although it is for a large-current application.

DETAILED DESCRIPTION OF THE EMBODIMENTS

1. First Embodiment

A structure according to a first embodiment of the present disclosure will be explained below in detail with reference to FIGS. 1 to 3.

(1) Structure

Figure 1:
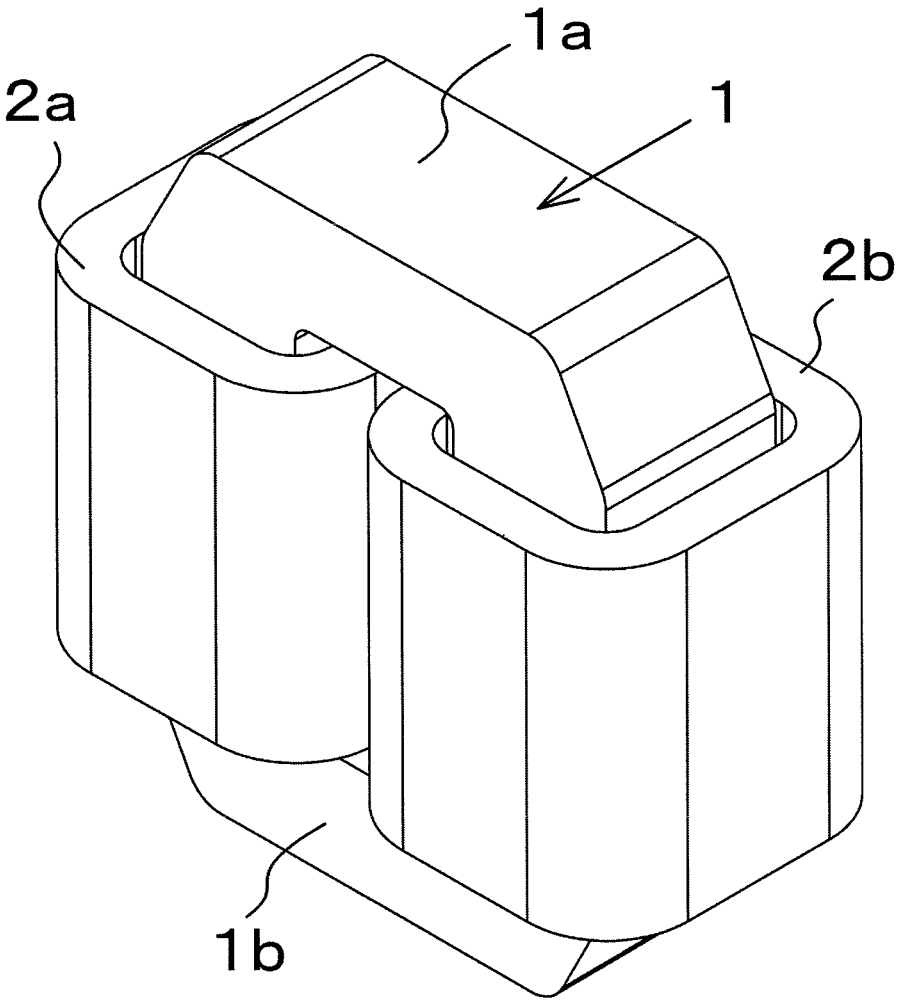
FIG. 1 is a perspective view illustrating a coupled inductor according to a first embodiment.
Figure 2:
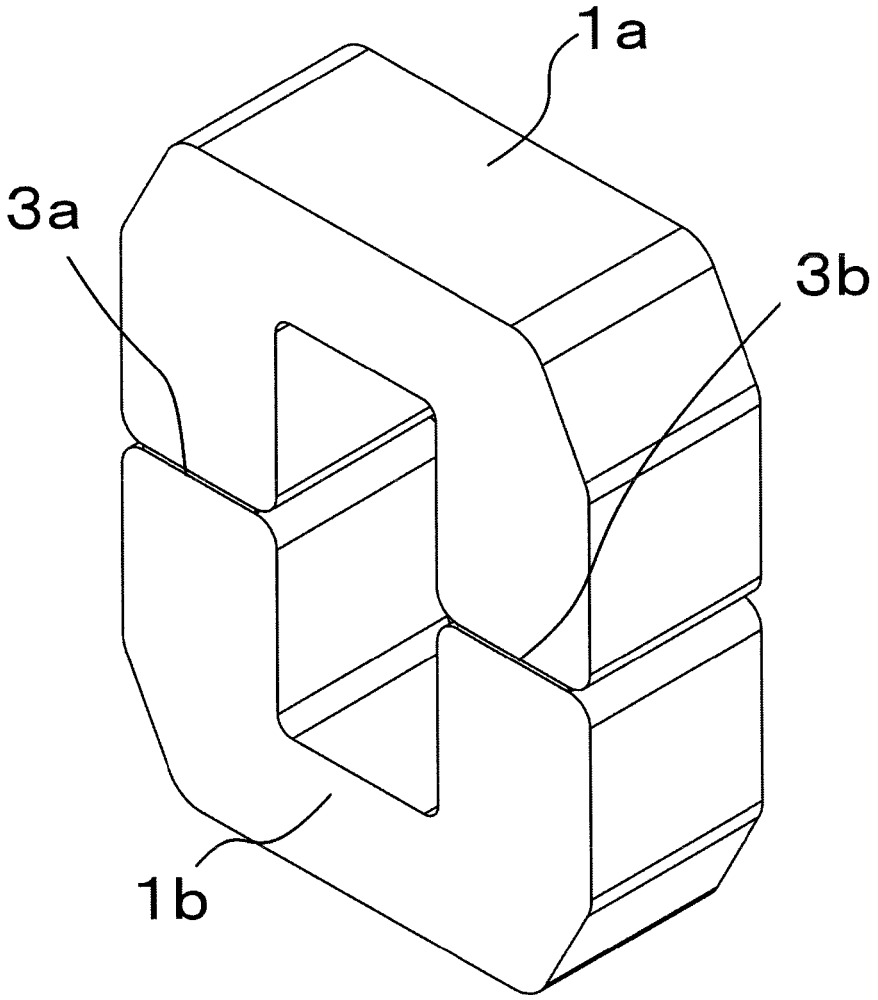
FIG. 2 is a perspective view illustrating a core according to the first embodiment.

As illustrated in FIG. 1, a coupled inductor of this embodiment has two coils 2*a*, 2*b* wound around an annular core 1, and currents are allowed to flow through the respective coils in such a way that magnetic fluxes generated from the two coils 2*a*, 2*b* are in the opposite directions. In other words, by winding the two individual coils 2*a*, 2*b* around the annular core 1, two coils 2*a*, 2*b* are magnetically coupled and generate the magnetic fluxes in mutual opposite directions to cancel the magnetic fluxes with each other. In this case, it is preferable that the coupling coefficient of the coupled inductor formed by the two coils should be equal to or smaller than 0.8. As illustrated in FIG. 2, as the annular core 1, two U-shaped core members 1*a*, 1*b* combined annularly by abutting the end faces thereof with each other are used. Gaps 3*a*, 3*b* are formed between the opposing faces of the U-shaped core members 1*a*, 1*b*.

Sendust cores are utilized as the core members 1*a*, 1*b*. In this embodiment, a sendust core is formed by adding a binder of silicon resin and a lubricant to aqueous atomized powders with an average particle diameter of 40 μm, shaping and calcinating the material. A magnetic condition of the present disclosure is that the maximum differential permeability is equal to or greater than 30. In general, it is ideal that the effective permeability of a reactor be substantially 30. Hence, it is necessary that the permeability of the core alone should be equal to or greater than 30 at minimum. That is, when the maximum differential permeability μ of the core alone becomes equal to or greater than 30, the effective permeability becomes 30 at maximum relative to the reactor. When the gaps 3*a*, 3*b* are formed under such a circumstance, the effective permeability of the reactor further decreases, and becomes close to an ideal value.

As to other magnetic characteristics of the sendust core of this embodiment, when the volume of the core is 1 $m^3$, the saturated flux density at 15000 A/m is equal to or greater than 0.5 T, the core loss at 10–kHz·100–mT is equal to or smaller than 50 $kW/m^3$, the core loss at 30–kHz·100–mT is equal to or smaller than 180 $kW/m^3$, and the core loss at 50–kHz·100–mT is equal to or smaller than 340 $kW/m^3$.

Figure 4:
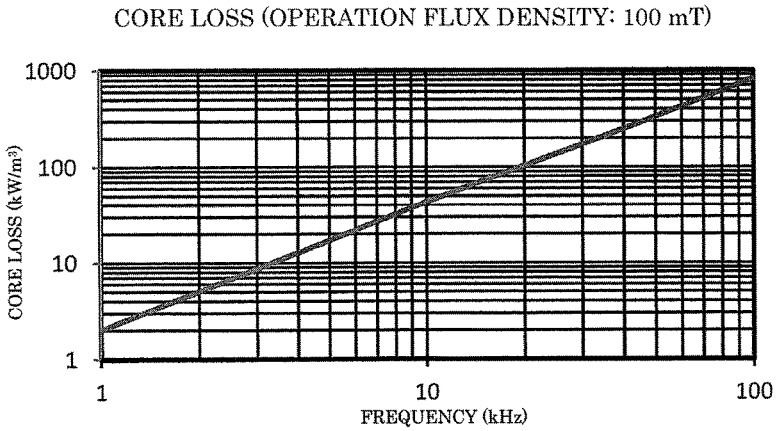
FIG. 4 is a graph illustrating a relationship between a frequency and a core loss of a sendust core according to this embodiment.

FIG. 4 illustrates a relationship between a loss and a frequency when the operation flux density of the sendust core of the present invention is 100 mT. It is preferable that the core loss should be lower than the graph in FIG. 4. A value in FIG. 4 is a value of the core loss when the operation flux density is 100 mT and the volume of the core is 1 $m^3$. The core loss of the reactor varies depending on the operation flux density and the core volume. Hence, in FIG. 4, as a representative value of the operation flux density, 100 mT is adopted, and in an actual reactor, the operation flux density varies depending on the cross-sectional area of the core and the number of turns of winding, etc.

The gaps 3*a*, 3*b* are not always necessary according to the present disclosure, but in this embodiment, spacers each formed of a ceramic sheet with a thickness of substantially 1 mm are disposed between end faces of the U-shaped core members 1*a*, 1*b* to form the gaps 3*a*, 3*b* in an appropriate size. As explained above, such gaps 3*a*, 3*b* set the effective permeability of the reactor to be a further appropriate value relative to a circuit used with this coupled inductor, and thus the effective permeability can be reduced in comparison with a gap-less reactor.

Figure 3:
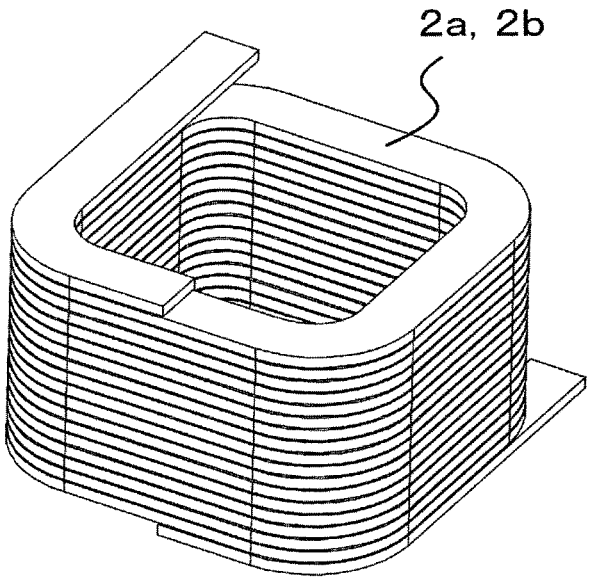
FIG. 3 is a perspective view illustrating an edgewise winding utilized according to the first embodiment.

As the two coils 2*a*, 2*b*, as illustrated in FIG. 3, edgewise windings (also called as flat windings) are utilized. In reactors, a conductive wire near the core generates large heat, and according to conventional round winding, the internal generated heat is not likely to be repelled due to the windings turned in multiple layers and unnecessary gaps between conductive wires, and thus the temperature rise is relatively large. Hence, a temperature difference between an internal conductive wire portion and an external conductive wire portion is large. In contrast, according to the edgewise winding, since the cross-section is rectangle, the winding cross-sectional area is large, and the space factor is improved, thereby decreasing the resistance value. In particular, according to the edgewise winding, a monolayer structure is employed relative to the internal diameter of the core, and thus the temperature difference occurs within the same cross-section. As a result, in accordance with the thermal conduction of copper, heat is dissipated to the external side without being blocked. Therefore, a heat dissipation performance is excellent and a temperature rise is small.

(2) Advantageous Effects

When a saturated flux density and a core loss are compared between a reactor including the sendust core of this embodiment and a reactor including a pure-iron-based dust core and a ferrite core under the same condition as that of the former reactor other than the material of the core, the following results were obtained. In table 1, the value of the pure-iron-based dust core was taken as a criterion value "1" to carry out a relative comparison with other cores. As is clear from table 1, the sendust core satisfies both saturated flux density and core loss, and is suitable for a large-current application.

TABLE 1

| | Pure-iron-based dust core | Ferrite core | Sendust core |
|---|---|---|---|
| Saturated flux | 1 | 0.2 | 0.5 |
| density | Excellent | Poor | Good |
| Core loss | 1 | 0.04 | 0.4 |
| | Poor | Excellent | Good |

Pure-iron-based dust core is taken as a criterion

Likewise, regarding reactors in the same shape, with the same dimension, and with the same coils wound therearound, under the condition in which the frequency was 30 kHz, and the operation flux density was 168 mT, a characteristics comparison was carried out for a ferrite core and a sendust core. The following results were obtained.

TABLE 2

| Characteristic Comparison | | | | | | | | | | | |
|---|---|---|---|---|---|---|---|---|---|---|---|
| | GAP THICKNESS | NUMBER OF GAPS | COUPLING COEFFICIENT | RIPPLE CURRENT (AVERAGE CURRENT): 94 A | | REACTOR LOSS | | | THERMAL CHARACTERISTIC (SIMPLE THERMAL ANALYSIS) | |
| | | | | Duty 29% | Duty50% | COPPER LOSS | IRON LOSS | Total | COIL | CORE |
| SENDUST | 0.0 mm | 0 | 0.72 | 24.0Ap-p | 21.0Ap-p | 175.0 W | 52.3 W | 227.3 W | 121.2° C. | 123.0° C. |
| FERRITE | 3.0 mm | 2 | 0.62 | 30.6Ap-p | 48.2Ap-p | 252.0 W | 3.8 W | 255.8 W | 138.2° C. | 112.2° C. |

As is clear from this table 2, with respect to the ripple current, the sendust core with a low current value accomplished a good result. With respect to the loss, the smaller loss was a good result, and the sendust core had a large iron loss than the ferrite core, but had a smaller ripple current. The sendust core had a gap width of 0 mm, and thus the copper loss indicates the low value. As a result, the sendust core had a smaller total loss. With respect to the thermal characteristic, the lower characteristic was a good result, and the sendust had a lower result, so that the similar result was accomplished for the sendust core with respect to the thermal characteristic.

Figure 5:
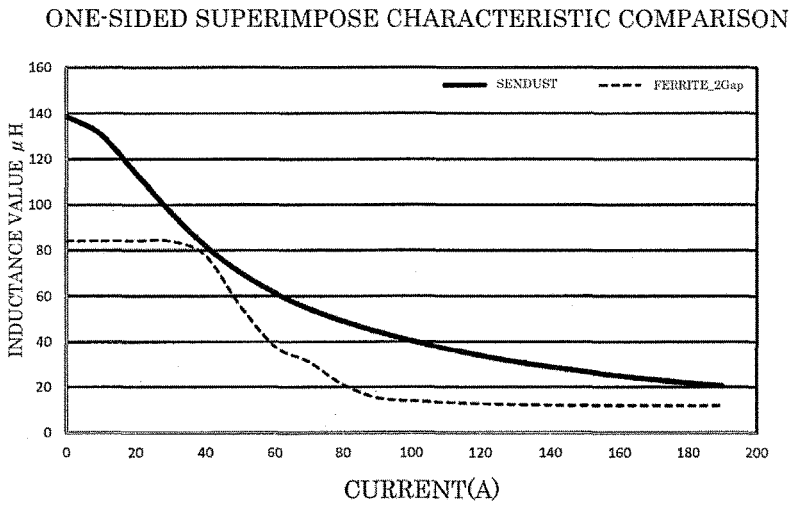
FIG. 5 is a graph for comparing a DC superimpose characteristic of a sendust core with that of a ferrite core.

FIG. 5 illustrates a single-sided superimpose characteristic of the ferrite core and that of the sendust core indicated in table 2. As is clear from this graph, the sendust core indicates an excellent characteristic even if no gap is formed in comparison with the ferrite core with two gaps.

Figure 6:
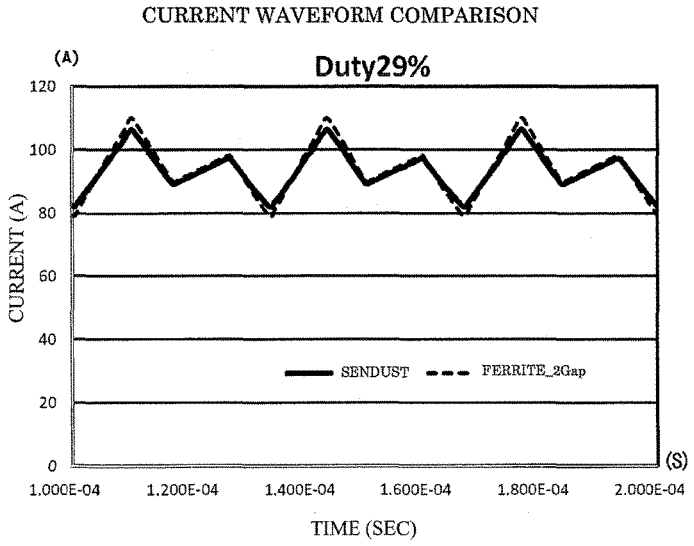
FIG. 6 is a graph for comparing a current waveform of the sendust core and that of the ferrite core when a duty is 29%.
Figure 7:
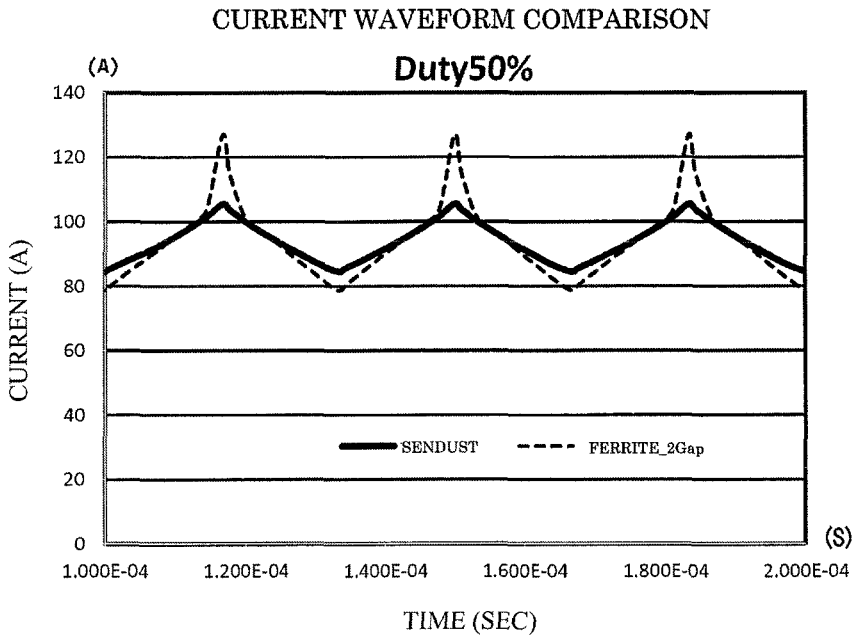
FIG. 7 is a graph for comparing a current waveform of the sendust core with that of the ferrite core when a duty is 50%.

FIGS. 6 and 7 illustrate a comparison result of a current waveform between the ferrite core and the sendust core indicated in table 2. FIG. 6 illustrates a current waveform when the duty is 29%, and FIG. 7 illustrates a current waveform when the duty is 50%. Those current waveforms are the current waveforms of a current flowing through either one of the coils 2*a*, 2*b* of the coupled inductor. As is clear from FIGS. 6 and 7, the sendust core of this embodiment has a little change in the current waveform regardless of a change in the duty, and the ripple in the current is little.

2. Other Embodiments

The present disclosure is not limited to the aforementioned embodiment, and covers the following other embodiments.

(1) As the annular core, in addition to the combination of the two U-shaped cores, an annular core formed by a single piece as a whole may be used. An annular core including one or multiple leg-portion cores provided between the two U-shaped cores may be used. As the leg-portion cores, for example, cores having I-shape, polygonal column shape, circular column shape, or elliptical shape may be used. Additionally, the cores of a cube or cuboid shape may be used. As a material for the leg-portion cores, The powder magnetic core formed by compression molding of the soft magnetic powder, the laminated core laminating the metal plate, The magnetic powder and the resin mixed core in which the magnetic core is dispersed, or the core formed by winding the thin film of iron-based amorphous alloy may be used. Moreover, an annular core formed by abutting two E-shaped cores with end faces thereof with each other may be used.

(2) Regarding the gap, gaps may be provided between the right and left core-legs, respectively as illustrated, or a gap-less structure may be employed. A further larger number of gaps may be provided.

(3) It is preferable that the coil should be formed of an edgewise winding, but a round winging may be applied. Coils may be wound around the right and left core-legs of the annular core, respectively, and two coils may be wound around one core-leg. The coil is not limited to a copper-made coil, and an aluminum-made coil may be applied.

What is claimed is:

1. A coupled inductor comprising:

an annular core including a sendust core having a maximum differential permeability that is equal to or greater than 30; and a coil wound around the core, wherein the coil includes two coils wound around the core such that magnetic fluxes generated from the two coils are oriented in opposite direction to each other, wherein the two coils are disposed in parallel to each other in a same axis direction, wherein a coupling coefficient of the coupled inductor formed by the two coils is equal to or smaller than 0.8.

2. The coupled inductor according to claim 1, wherein the annular core is formed by combining a plurality of cores.

3. The coupled inductor according to claim 2, wherein the annular core comprises two U-shaped core members abutting end faces thereof with each other.

4. The coupled inductor according to claim 2, wherein the annular core comprises a gap formed between opposing end faces of respective cores.

5. The coupled inductor according to claim 4, wherein the gap is formed by disposing a spacer made of ceramic plate between the opposing end faces of the respective cores.

6. The coupled inductor according to claim 1, wherein the coil comprises an edgewise winding.

* * * * *